US008793932B1

(12) United States Patent
Lindgren

(10) Patent No.: US 8,793,932 B1
(45) Date of Patent: Aug. 5, 2014

(54) OPENABLE INSERT FOR DOOR AND METHOD OF INSTALLATION

(76) Inventor: Jeff Lindgren, Rocklin, CA (US)

( * ) Notice: Subject to any disclaimer, the term of this patent is extended or adjusted under 35 U.S.C. 154(b) by 161 days.

(21) Appl. No.: 12/931,502

(22) Filed: Feb. 1, 2011

Related U.S. Application Data

(60) Provisional application No. 61/337,359, filed on Feb. 2, 2010.

(51) Int. Cl.
*E05B 65/04* (2006.01)
*E05C 7/02* (2006.01)

(52) U.S. Cl.
USPC ..... 49/67; 49/62; 49/63; 49/56; 49/501

(58) Field of Classification Search
CPC ..... E06B 9/02; E06B 9/04; E06B 2009/002; E06B 2009/005
USPC ..... 49/50, 54, 56, 61, 62, 63, 65, 67, 463, 49/465, 501
See application file for complete search history.

(56) References Cited

U.S. PATENT DOCUMENTS

| | | | | | |
|---|---|---|---|---|---|
| 1,738,539 | A * | 12/1929 | Moss | 232/1 E |
| 1,859,974 | A * | 5/1932 | Kroenke | 160/97 |
| 2,853,161 | A * | 9/1958 | Mascari | 52/212 |
| 3,184,801 | A * | 5/1965 | Fletcher | 49/459 |
| 3,871,434 | A * | 3/1975 | Hance | 160/91 |
| 3,895,669 | A * | 7/1975 | Heeling | 160/92 |
| 4,592,167 | A * | 6/1986 | Andrawos | 49/171 |
| 4,920,718 | A * | 5/1990 | Artwick et al. | 52/476 |
| 4,947,597 | A * | 8/1990 | Simpson | 52/208 |
| 5,018,330 | A * | 5/1991 | Lewkowitz | 52/455 |
| 5,535,550 | A * | 7/1996 | Yang | 49/163 |
| 5,577,355 | A * | 11/1996 | Leonelli | 52/204.62 |
| 5,636,484 | A * | 6/1997 | DeBlock | 52/204.5 |
| 5,749,184 | A * | 5/1998 | McKann | 52/204.1 |
| 5,765,325 | A * | 6/1998 | DeBlock | 52/204.5 |
| 5,950,398 | A * | 9/1999 | Hubbard | 52/786.1 |
| 6,151,849 | A * | 11/2000 | Twigg et al. | 52/208 |
| 6,272,801 | B1 * | 8/2001 | Suh | 52/211 |
| 6,318,037 | B1 * | 11/2001 | Hansen | 52/208 |
| 6,763,647 | B2 * | 7/2004 | Yeany | 52/786.1 |
| 6,931,810 | B2 * | 8/2005 | Beaudoin et al. | 52/455 |
| 7,386,959 | B2 * | 6/2008 | Ouellette | 52/204.53 |
| 8,136,326 | B2 * | 3/2012 | Yan | 52/656.6 |
| 8,146,304 | B1 * | 4/2012 | Plummer et al. | 52/204.61 |
| 8,297,007 | B2 * | 10/2012 | Sayer | 52/171.1 |
| 2003/0000163 | A1 * | 1/2003 | Lamanna | 52/204.62 |
| 2007/0193140 | A1 * | 8/2007 | Carnick et al. | 52/208 |

OTHER PUBLICATIONS

Lindgren, Jeff; Exhibit A; Non-Published Sketch of Door Insert Sold in the U.S. Before Feb. 2, 2009.

* cited by examiner

*Primary Examiner* — Katherine Mitchell
*Assistant Examiner* — Shiref Mekhaeil
(74) *Attorney, Agent, or Firm* — Heisler & Associates

(57) ABSTRACT

A hole in a door is fitted with an insert The insert includes a frame assembly and a mounting plate which are affixed together and sandwiching portions of the door adjacent the hole therebetween. The frame assembly further includes a lattice spanning the hole. An inner door is pivotably mounted to the mounting plate for selectively opening and closing the insert. The frame assembly is configured to support a screen adjacent thereto and inboard of the inner door.

14 Claims, 8 Drawing Sheets

OPENABLE INSERT FOR DOOR AND METHOD OF INSTALLATION

CROSS-REFERENCE TO RELATED APPLICATIONS

This application claims benefit under Title 35, United States Code §119(e) of U.S. Provisional Application No. 61/337,359 filed on Feb. 2, 2010.

FIELD OF THE INVENTION

The following invention relates to doors and other structures having holes therein which can receive an openable insert. More particularly, this invention relates to decorative inserts for doors which also function to open and close to allow light and ventilation to pass through the insert in a selectable fashion while maintaining security through the insert.

BACKGROUND OF THE INVENTION

The front door of a home and often other doors within the home are typically designed both to function for passage into and out of the home and also to present an attractive appearance to those visiting or passing by the home. It is known in the prior art to make such front doors out of wood or combinations of wood and glass, and also in some instances to make the front door out of iron or a combination of iron and glass. In other instances, the door is made of fiberglass or other synthetic materials but typically made to have the appearance of wood or iron. Sometimes the door is presented as a single door and sometimes double doors are provided at this decorative door location.

One problem often presented at the door location in many instances is that the decorative door is provided on a front side of the house which is otherwise not a particularly secure location, and yet it is desirable to allow ventilation through the door. Also, it is desirable to communicate safely with a visitor who comes up to the home without allowing the visitor access into the home. Furthermore, it is often desirable to have additional light in the space inside the home adjacent the large decorative door space, such as by providing a large amount of glass on the front door.

One technique for addressing the problem of ventilation through the front door, light passage through the front door and the opportunity to safely communicate with a visitor through the front door, is to form the front door with a main frame that pivots on hinges and then an insert within the main frame that separately opens within the door. One particular form of insert and associated door which has become popular in the late twentieth and early twenty-first centuries is an iron or steel door with a wrought iron central area insert with a second door pivotably mounted to the insert. Such doors are rather heavy, requiring a steel door frame to hold the weight of the door. The wrought iron insert has a fixed lattice of wrought iron which is both decorative and provides security when the insert is in an open orientation. An openable portion of the insert inboard of the fixed lattice includes a glass door. When this glass inner door is closed, light can still pass into the building. When the glass door is open, communication can happen safely through the wrought iron lattice and ventilation is provided. If desired, a screen can be provided inside of the wrought iron lattice so that flying insects are precluded while ventilating air can still pass through and communication can occur.

More recently, wrought iron inserts have been devised which can mount within a wooden door hanging on hinges mounted to a wooden door frame. Typically, such wrought iron inserts within wooden doors have not been as effective as wrought iron inserts within iron or steel doors. In particular, many such wrought iron inserts within wooden doors are not configured to be openable. Others have been difficult to install. Also, such inserts don't work on foam filled core doors, such as fiberglass doors or other doors with a hollow core or a core that is filled with a non-structural material.

With this invention, it is desirable to use an existing wooden door and keep the mounting of the existing wooden door the same as in the original installation, but merely cut a hole in the wooden door and hang the new wrought iron insert into the hole in the wooden (or fiberglass or other materials) door, and have the wrought iron insert provide all of the functionality of prior art wrought iron doors. Such a door would enjoy simplicity of installation and be sufficiently light weight to hang on the door within the existing traditional wooden door frame, while still providing all of the benefits of completely iron/steel doors which require the use of heavy steel door jambs.

SUMMARY OF THE INVENTION

With this invention, a wrought iron door insert is provided which can be mounted into an existing door formed of wood or other materials. The insert includes a frame assembly made of a lattice portion, trim portion and body portion. The body portion preferably resides inside a perimeter of the hole in the door. The trim is located adjacent to the body and at an edge of the hole in the door adjacent an outside surface of the door. The lattice extends inboard of the body to fill and span the hole in the door. This lattice is typically a web of wrought iron or other rigid elongate decorative elements which also provide a security function while still allowing ventilation, light and communication through the frame assembly. The frame assembly is preferably provided as a single rigid piece made up of these separate parts, which are formed together or bonded or otherwise attached together.

A second portion of the insert includes a mounting plate. The mounting plate is configured to be adjacent perimeter edges of the hole in the door and on an inside surface of the door. The mounting plate circumscribes this hole as does the frame assembly. Holes in the mounting plate and in the frame assembly are aligned together and can receive fasteners, such as screws, passing through the mounting plate and then into the frame assembly. In this way, the mounting plate is secured to the frame assembly. The configuration of the mounting plate and frame assembly is such that portions of the door adjacent edges of the hole are sandwiched between the mounting plate and frame assembly. Thus, the frame assembly and mounting plate are not only securely attached together but also securely cause the frame assembly and mounting plate to be coupled to the door and filling the hole in the door.

The mounting plate additionally supports portions of barrel hinges thereon. An inner door is provided, typically including a rigid frame surrounding a glass panel. This rigid frame includes portions of barrel hinges thereon which can cooperate which portions of the barrel hinges mounted to the mounting plate. With such a configuration, the inner door can be hung from the mounting plate and pivotably open and close into and out of the hole in the door inboard of the body portion of the frame assembly. Weather stripping is preferably provided to allow the inner door to seal when closed adjacent the mounting plate and other portions of the frame assembly of the insert. A screen can optionally be provided between the inner door and other portions of the insert.

When installing the wrought iron door insert, first an existing door has a hole cut in it sized similar to that of the wrought iron door frame. Typically, the existing door is taken off of its hinges and longer or otherwise stronger bolts are utilized to enhance the strength of the hinges of the door if necessary. The wrought iron door insert is fitted into this hole that is cut into the door. In particular, the frame assembly and mounting plate are placed within and adjacent the inner and outer sides of the hole cut in the door and then coupled together, such as by utilizing the series of screws. Once this frame has been secured to the hole in the existing door, the glass door frame is merely coupled to the mounting plate through the barrel hinges to complete the assembly. The door is now ready to be remounted to the hinges of the door frame. It is also conceivable that the entire assembly process could occur without ever taking the door off of the door frame hinges, to even further simplify the mounting process for the wrought iron door inserts of this invention.

The particular details of this invention which are of special benefit include that the mounting hardware is simply in the form of a series of screws which are all attached from the inside of the door. On an exterior of the door, trim is provided that accommodates secure attachment but without allowing individuals outside of the home to gain access to these fasteners. The interface between the metal frame and the pivoting wrought iron door insert is configured to provide a low profile junction with a smooth finish without abrupt edges or corners, leaving the door with the appearance that it was originally constructed to have its final configuration. As an alternative, doors formed of a combination of wood or other materials and the wrought iron insert can be manufactured as original equipment for installation within a door space, rather than merely being provided as a retrofit. The wrought iron lattice can have any of a variety of different configurations. Conceivably some of these configurations could accommodate passageways for pets to pass into and out of the home or to allow the passage of mail or small packages through the wrought iron lattice.

The inner door can be merely clear glass or can be beveled or otherwise decorative glass which can include colors and/or light distorting elements therein to minimize the ability of those outside the home to see into the home while still allowing light to pass into the home through the glass door. Latches are provided on the openable inner door portion of the wrought iron insert to secure the door insert in the closed position, which latches are on the inside surface of the door. The latch of the existing door and associated locks are not interfered with by the modification of the existing door to include the wrought iron insert of this invention.

OBJECTS OF THE INVENTION

Accordingly, a primary object of the present invention is to provide a door which has an openable insert therein which maintains security when open and allows ventilation and communication to occur through the insert when open.

Another object of the present invention is to provide an insert mountable within a hole in a door or a hole in some other substantially planar structure to allow for openability and selective access through the hole, especially for light, air ventilation and communication therethrough.

Another object of the present invention is to provide a method for modifying a door or other planar structure to include an openable insert therein.

Another object of the present invention is to provide an insert for a door or other planar structure which is easy to install.

Another object of the present invention is to provide an insert for a door or similar structure which does not require modification of the door or similar structure other than to cut a hole in the door for fitting of the insert therein.

Another object of the present invention is to provide an insert for a door which maintains security functions for the door while allowing for ventilation, communication and light passage through the insert in the door.

Another object of the present invention is to provide an insert for a door or similar structure which has an attractive decorative appearance.

Another object of the present invention is to provide an insert for a door which is secured to a hole in the door with fasteners accessed exclusively from an inside of the door to prevent removal of the insert from an exterior of the door.

Another object of the present invention is to provide an openable insert for mounting within a hole in a door or similar structure which can include a screen therein between an openable inner door and a lattice portion of the insert.

Another object of the present invention is to provide an openable insert for a door or other planar structure which maintains a substantially weatherproof seal when closed.

Another object of the present invention is to provide an openable door insert that is equally installable into wood or fiberglass doors, and other doors filled with foam or otherwise containing non-structural filler material therein.

Other further objects of the present invention will become apparent from a careful reading of the included drawing figures, the claims and detailed description of the invention.

DESCRIPTION OF THE PREFERRED EMBODIMENT

Figure 2:
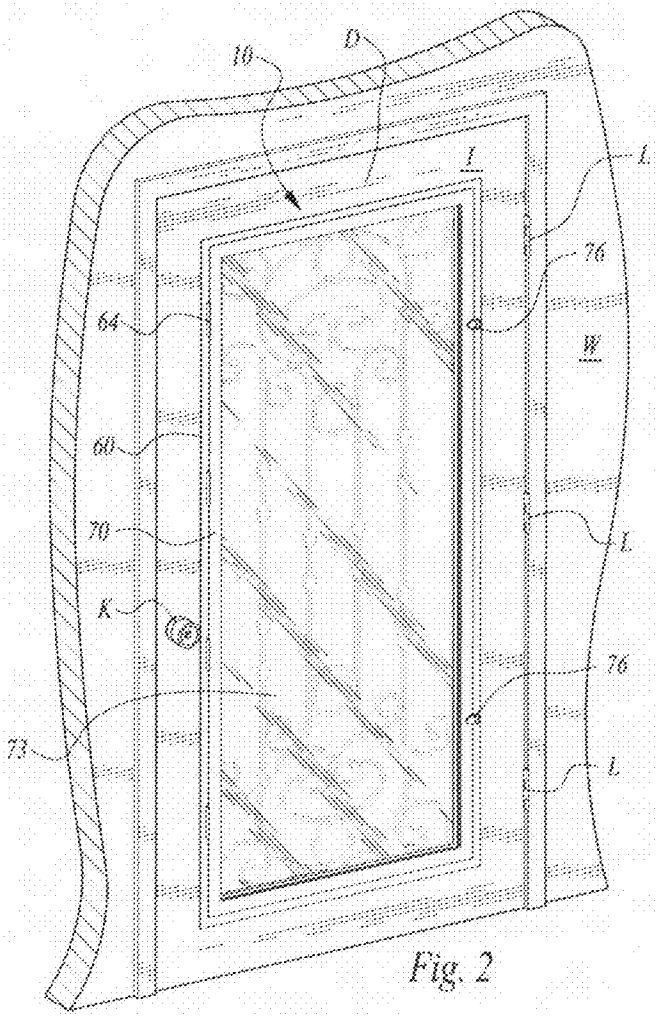
FIG. 2 is a perspective view similar to that which is shown in FIG. 1 but from an inside of the structure in which the door is mounted.

Referring to the drawings, wherein like reference numerals represent like parts throughout the various drawing figures, reference numeral 10 (FIGS. 1-3) is directed to an insert mountable within a hole H in a door D or other similar planar structure. The insert 10 is securely mounted to the door D, filling the hole H and maintaining security for the door D. The insert 10 includes an inner door 70 which can pivotably open to selectively allow air circulation through the insert 10 while maintaining security, and also allowing light to pass through the insert 10, both when the inner door 70 is open or closed, such as by forming the inner door 70 of glass 73. A method for installing the insert 10 within the hole H in the door D or some other planar structure is also disclosed according to this invention.

Figure 1:
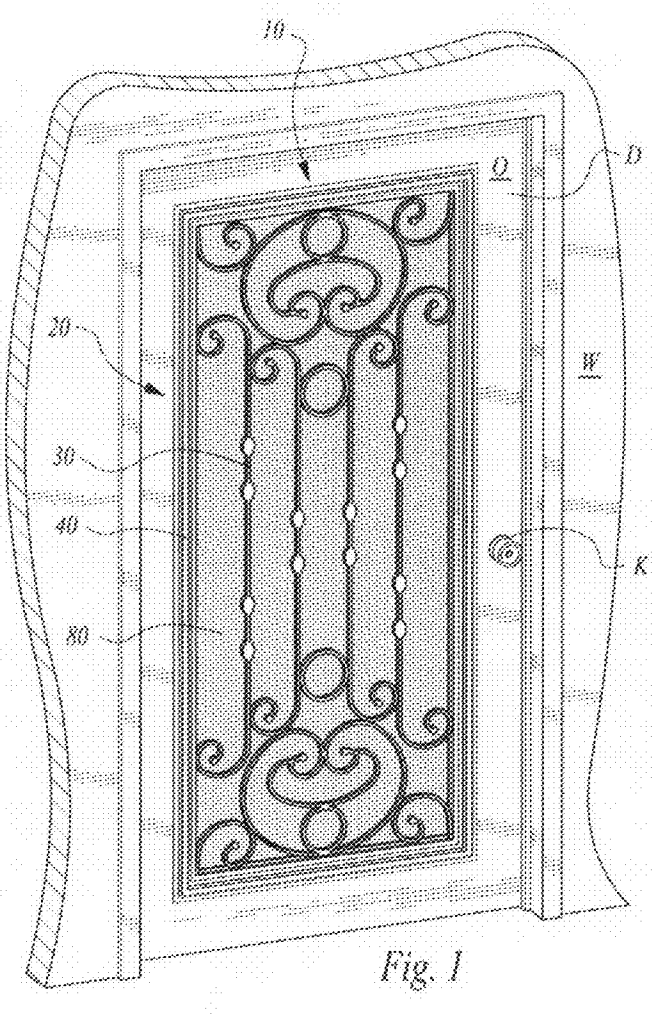
FIG. 1 is a perspective view of a door mounted within a door space and including an insert according to a preferred embodiment of this invention mounted within a hole in the door.
Figure 3:
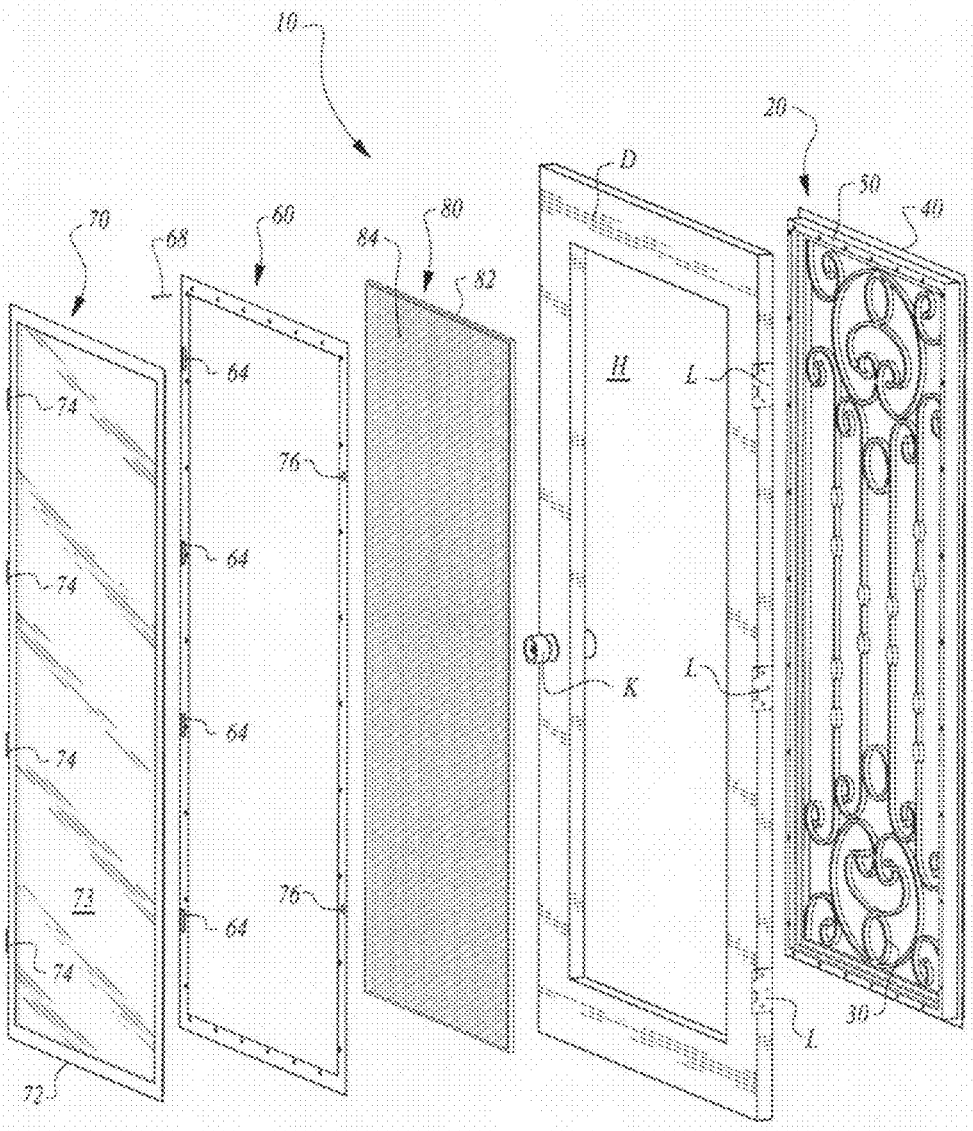
FIG. 3 is a perspective exploded parts view of that which is shown in FIGS. 1 and 2, illustrating major subassemblies of the insert of this invention and how these subassemblies are joined together within a hole in the door.
Figure 4:
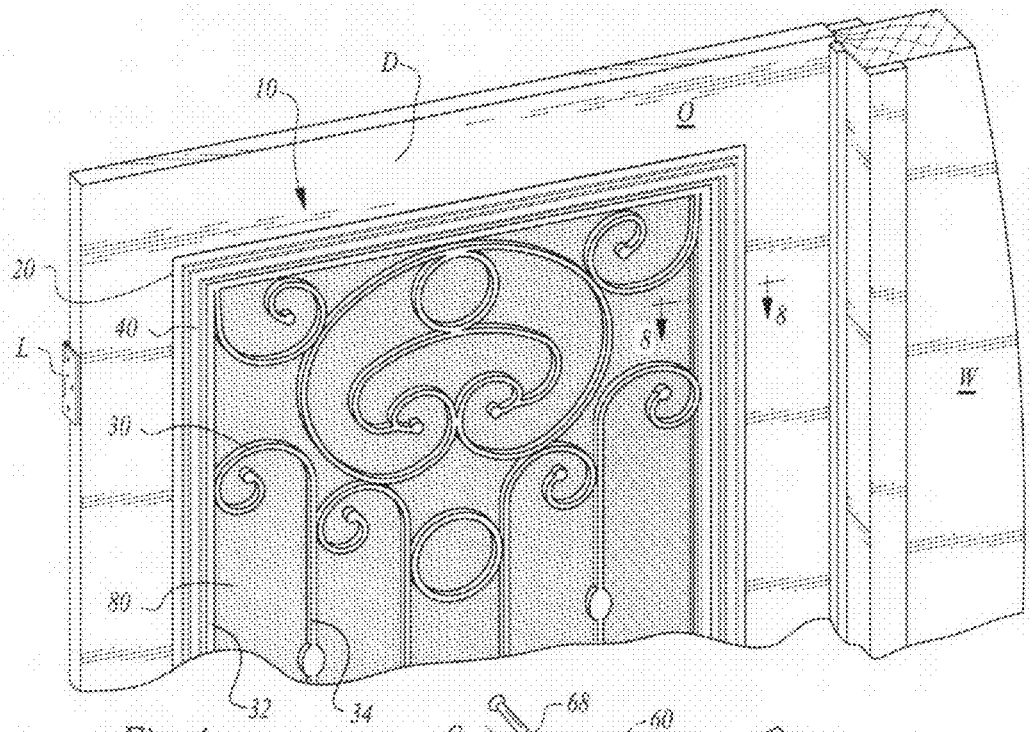
FIG. 4 is a perspective view of a portion of that which is shown in FIG. 1, further illustrating details of the insert of this invention.

In essence, and with particular reference to FIGS. 1-3, basic details of the insert 10 of this invention are described according to a preferred embodiment and where the insert 10 is illustrated as mounted within a door D. The door D is typically a planar structure of substantially constant thickness between an inside surface I and an outside surface O, and pivotably mounted to a portal within a wall W, such as through leaf hinges L. This hole H in the door is typically rectangular in form (FIG. 3). A knob K on the door D allows for actuation of a latching mechanism of the door D and associated locking mechanism. The knob K and leaf hinges L could be swapped if desired. Also, the insert 10 can have an opening side adjacent the knob K side of the door D or opposite the knob K side of the door D. Screws that hold the door D to the wall W through the leaf hinges L can be enlarged and/or lengthened if needed to support the added weight of the insert 10.

The insert 10 is sized similar to the size of the hole H in the door D. This insert 10 includes a frame assembly 20, a mounting plate 60 and an inner door 70. The frame assembly 20 includes a lattice portion 30, a trim portion 40 and a body portion 50. The body portion 50 resides inboard of edges of the hole H and preferably has a thickness similar to a thickness of the door D. The trim portion 40 is sized to overlie the edge of the hole H and rest adjacent the outside surface O of the door D adjacent the hole H. The lattice 30 extends inboard of the body 50 to span the hole H in the door D. The lattice portion 30, trim portion 40 and body portion 50 are preferably each rigidly joined together or originally formed together to together provide the frame assembly 20.

Figure 5:
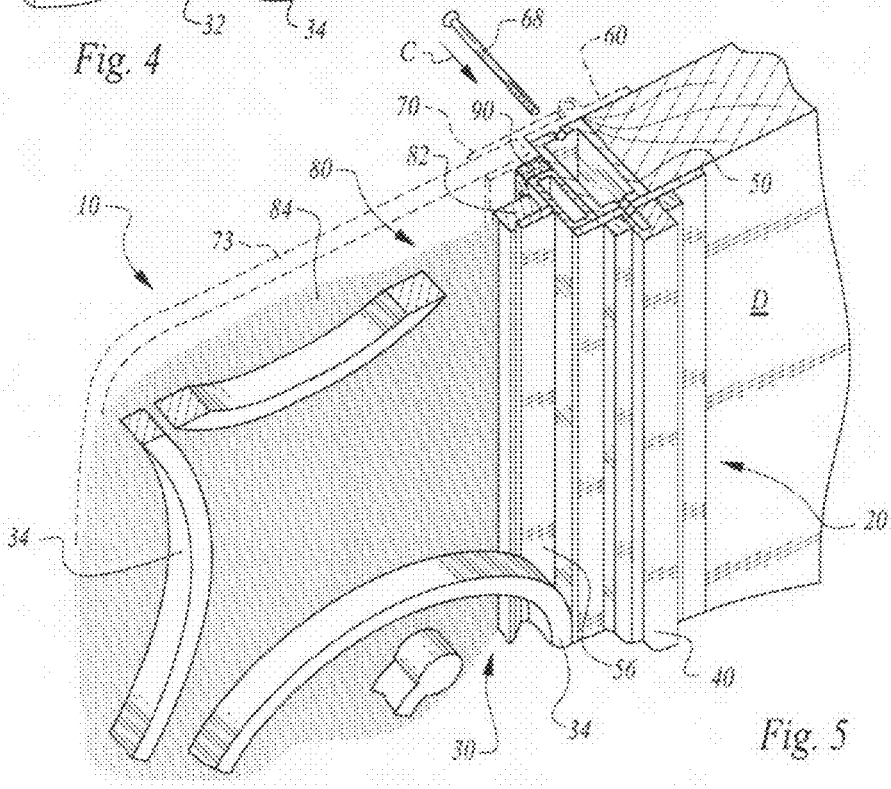
FIG. 5 is a perspective view of a portion of that which is shown in FIG. 4 with portions of the door and insert cut away to reveal structural details of the insert and with an inner door thereof shown in broken lines and illustrating how fasteners are used to secure a mounting plate portion shown in broken lines with a frame assembly portion of the insert of this invention.
Figure 6:
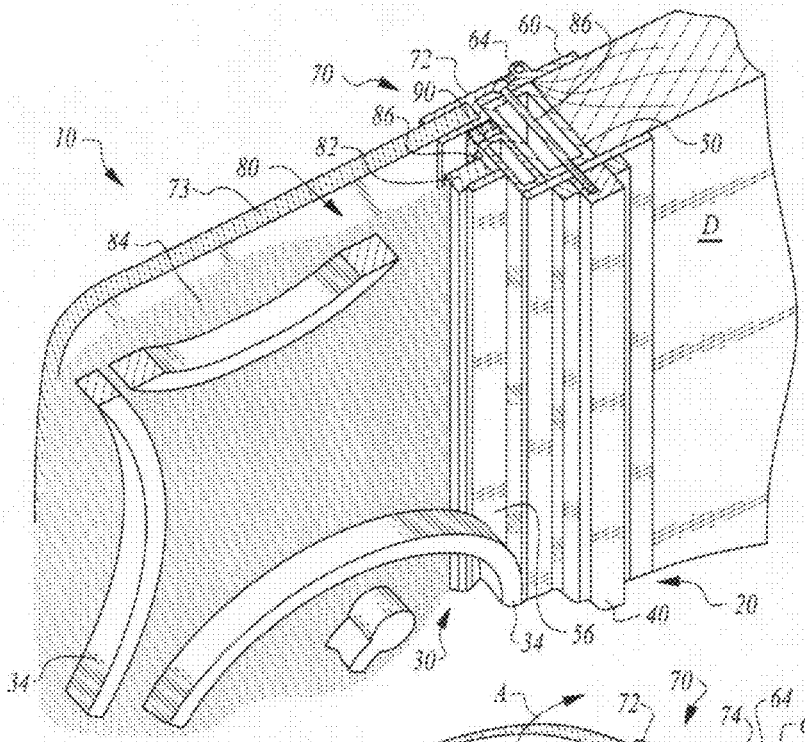
FIG. 6 is a perspective cut away view similar to that which is shown in FIG. 5, but with the inner door shown in solid lines and after completion of the mounting process, and illustrating the insert with the inner door closed.
Figure 7:
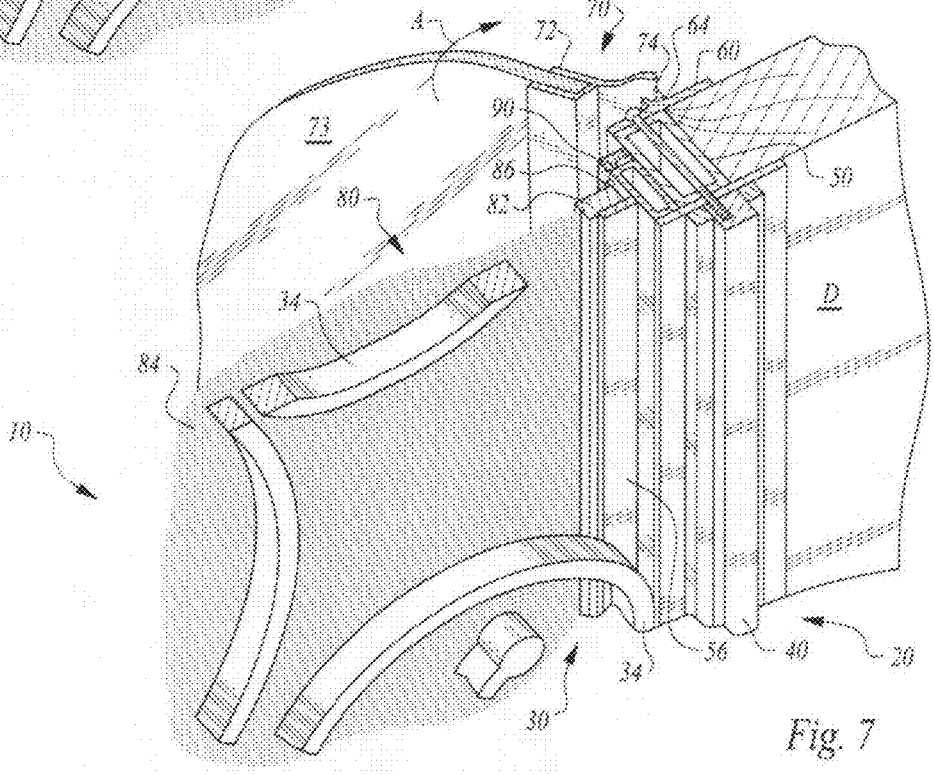
FIG. 7 is a perspective cut away view similar to that which is shown in FIG. 6, but with the inner door shown open.
Figure 8:
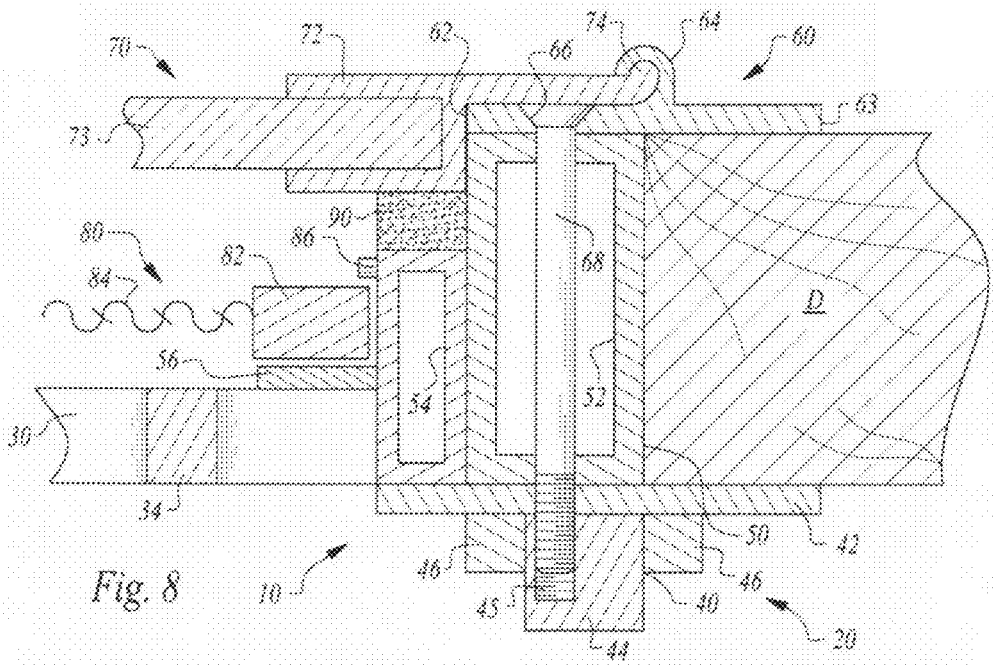
FIG. 8 is a sectional view taken along line 8-8 of FIG. 4 and illustrating structural details of the insert when mounted within a hole in the door.
Figure 14:
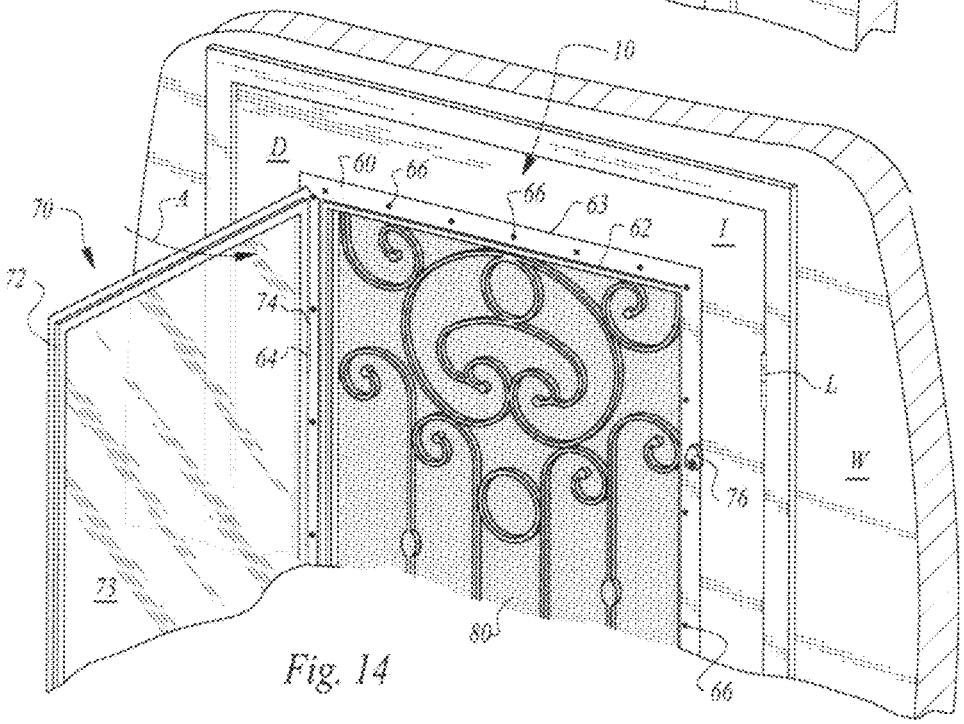
FIG. 14 is a perspective view similar to that which is shown in FIG. 13, but with the inner door shown open.

The mounting plate 60 is preferably a planar plate sized to overlie the edges of the hole H adjacent the inside surface I of the door D. Screws 68 or other fasteners are provided to join the mounting plate 60 to the frame assembly 20 (see FIGS. 5-9). The mounting plate 60 and frame assembly 20 are sized so that when the screws 68 or other fasteners join the mounting plate 60 to the frame assembly 20 (along arrow C of FIG. 5), portions of the door D adjacent the hole H are sandwiched between the frame assembly 20 and mounting plate 60. The frame assembly 20 and mounting plate 60 thus attach to form a single rigid structure. The inner door 70 is pivotably mounted to the mounting plate 60 to pivot (along arrow A of FIGS. 7 and 14) between a closed position closing off access through the hole H in the door D and an open position allowing ventilation through the hole H in the door D.

A screen 80 can optionally be provided between the inner door 70 and the lattice 30 portion of the frame assembly 20. Weather stripping 90 seals the inner door 70 to the frame assembly 20 and/or the mounting plate 60 to limit leakage between the inner door 70 and other portions of the insert 10 when the inner door 70 is closed.

With continuing reference to FIGS. 1-3, as well as reference to FIGS. 4-10, particular details of the frame assembly 20 and the various subparts of the frame assembly 20 are described, according to this preferred embodiment. The frame assembly 20 is preferably formed by welding or otherwise bonding separate structures together including the lattice 30, trim 40 and body 50. However, other forming techniques can be provided for forming the frame assembly 20, including extruding the trim portion 40 and body portion 50 together, or utilizing molding techniques, pressing techniques, milling techniques or other shaping techniques to form the frame assembly 20 having the desired geometry.

At a minimum, the frame assembly 20 provides one-half of a system for sandwiching portions of the door D therebetween, along with the mounting plate 60 for secure attachment of the insert 10 to the door D within the hole H. In this preferred embodiment, the lattice 30 preferably is formed of wrought iron and has multiple decorative elements 34.

The decorative elements 34 are preferably elongate rods including bent sections of various different cross-sectional shapes. These decorative elements 34 preferably fill a portion of the lattice 30 inboard of the body portion 50 sufficient to minimize gaps therebetween. For instance, these gaps can be sufficiently small to prevent an intruder from accessing the knob K of the door D by reaching between decorative elements 34 in the lattice 30. Alternatively, some openings between adjacent decorative elements 34 could be sufficiently spaced to allow small packages to be passed between decorative elements 34 forming the lattice 30. As a further alternative, certain gaps in the decorative elements 34, especially near a bottom of the lattice 30, could be sized sufficiently large to allow animals to pass through the door D when the inner door 70 is opened. While the lattice 30 is preferably formed of wrought iron, this lattice 30 could be formed of other materials and have other configurations to provide decorative or functional attributes to the lattice 30 portion of the frame assembly 20.

The portions of the lattice 30 at edges thereof are preferably bonded to the body 50 on an inboard side of the body 50. Alternatively, the lattice can be formed with at least portions of the body 50. As an alternative, a border of wrought iron or similar material could be provided between the decorative elements 34 and the body 50 of the frame assembly 20.

The trim portion 40 of the frame assembly 20 preferably defines that portion of the frame assembly 20 which remains outboard of the outside surface O of the door D when the insert 10 is coupled to the door D. This trim 40 preferably extends about a perimeter of the hole H with a width sufficient so that the trim 40 partially overlies the hole H and partially overlies portions of the outside surface O of the door D adjacent the hole H.

The trim 40 preferably includes a base plate 42 (FIGS. 8-10) defining a width of the trim 40 between an inner edge and outer edge thereof. A central block 44 is preferably coupled to the base plate 42. Side blocks 46 preferably are located on either side of the central block 44 and adjacent the base plate 42. These blocks 44, 46 provide a decorative tiered shape to the trim 40.

Furthermore, the central block 44 provides depth into which an interior bore 45 can be provided for securing of a portion of the screw 68 or other fastener. The blocks 44, 46 also add additional rigidity to the trim 40 to resist distortion of the trim 40 and enhance a stiffness of the trim 40, particularly to prevent or significantly discourage an intruder from utilizing a crowbar or other wedge to attempt to separate the trim 40 of the frame assembly 20 away from the door D.

Figure 11:
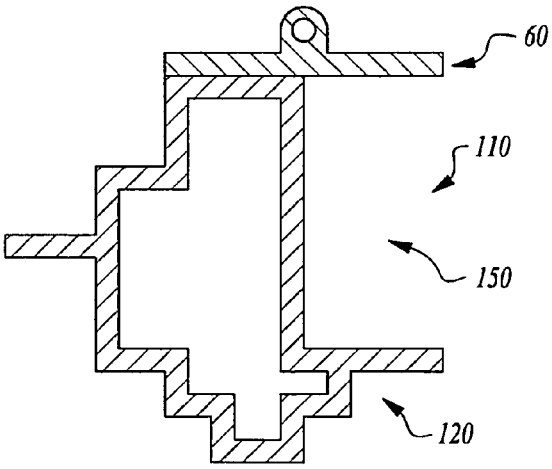
FIG. 11 is a full sectional view similar to that which is shown in FIG. 10, but for an alternative embodiment where body and trim portions of the frame assembly of the insert are formed as a single extrusion having the desired contour, rather than from separate subparts joined together.
Figure 12:
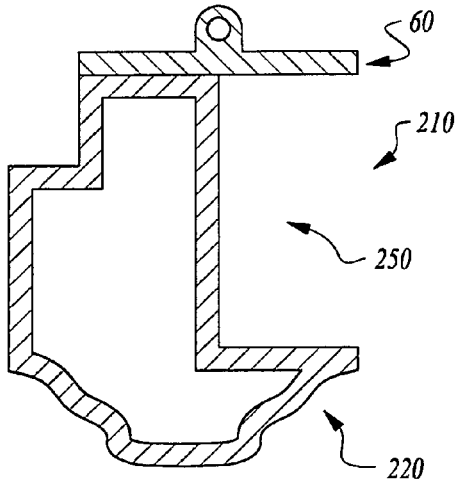
FIG. 12 is a full sectional view similar to that which is shown in FIGS. 10 and 11, but for a stylized modification of the extrusion forming the frame assembly of the insert, according to a second alternative embodiment.
Figure 13:
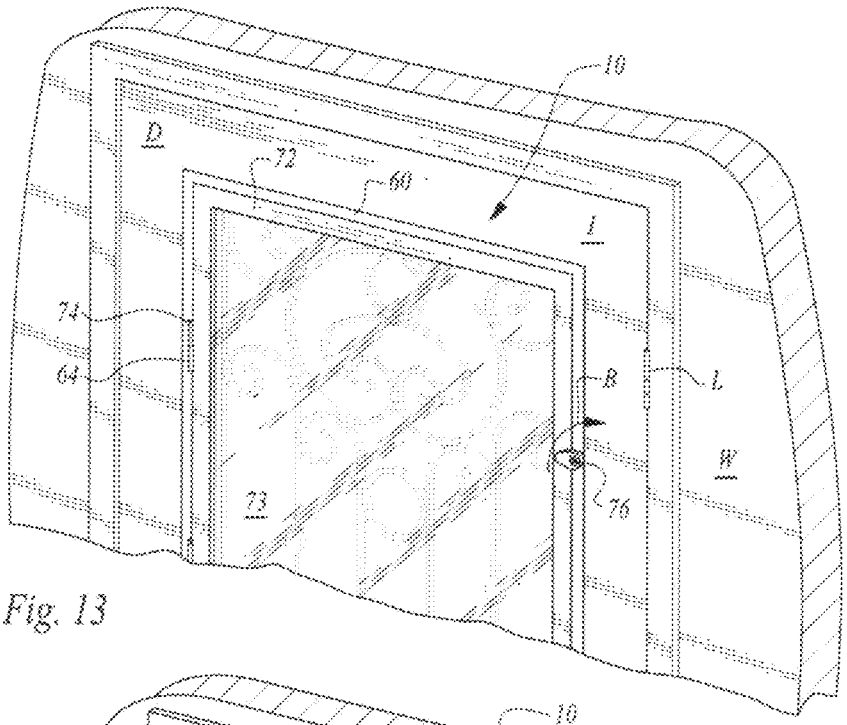
FIG. 13 is a perspective view of a portion of the door including the insert therein and mounted within a wall, and illustrating the operation of a latch for opening and closing of the inner door of the insert.

These blocks 44, 46 can be welded to the base plate 42 or otherwise bonded. Alternatively, the blocks 44, 46 can be formed with the base plate 42, such as in an extrusion process, as depicted with the alternative insert 110 of FIG. 11 where an alternative frame assembly 120 including an alternative body 150 is formed as a single extrusion. As a further alternative, a second alternative insert 210 can include a second alternative frame assembly 220 and second alternative body 250 which has a more curved and rounded form (FIG. 12). Other forms could similarly be provided as desired by a designer.

The body portion 50 defines that portion of the frame assembly 20 which extends into the hole H and toward the mounting plate 60. Preferably, the body 50 has sufficient depth so that the body 50 comes into contact with the mounting plate 60. The body 50 in this preferred embodiment is formed of multiple tubular members of rectangular cross-sectional form including an outer member 52 and an inner member 54. The outer member 52 is sized to abut vertical sides of the hole H on an outer portion thereof. It is not necessary that the outer member 52 be touching the vertical sides of the hole H, but merely that dimensions of this outer member 52 be somewhat similar to dimensions of the hole H so that the base plate 42 of the trim 40 and the mounting plate 60 cover the hole H.

The outer member 52 is preferably hollow to minimize weight thereof while still maintaining strength. Holes are typically provided through the outer member 52 for passage of the screws 68 or other fasteners to join the mounting plate 60 to the frame assembly 20. These holes also typically pass through the base plate 42 and central block 44.

The inner member 54 is preferably provided to supply a ledge upon which weather stripping 90 can be positioned for sealing of the inner door 70 relative to the body 50 of the frame assembly 20. If desired, weather stripping 90 can also be provided abutting an optional border of the lattice 30. In another embodiment, a further inner member can be supplied as a portion of the body 50 similar to the inner member 54, but progressively smaller in size than the inner member 54 and outer member 52. With such multiple inner members 54 of sequentially smaller size, multiple ledges are provided upon which weather stripping 90 can be positioned to provide multiple seals for the inner door 70. Most preferably, an arrangement such as that depicted in FIGS. 5-10 is followed where a flange 56 is affixed to and extends inboard of the inner member 54 of the body 50. This flange 56 acts as a screen rest. If no screen is provided, an inner door can be provided with a frame which has two steps, one of which rests on weather stripping 90 on the inner member 54 and one of which rests on weather stripping 90 resting upon a flange 56 formed in the body 50.

Figure 9:
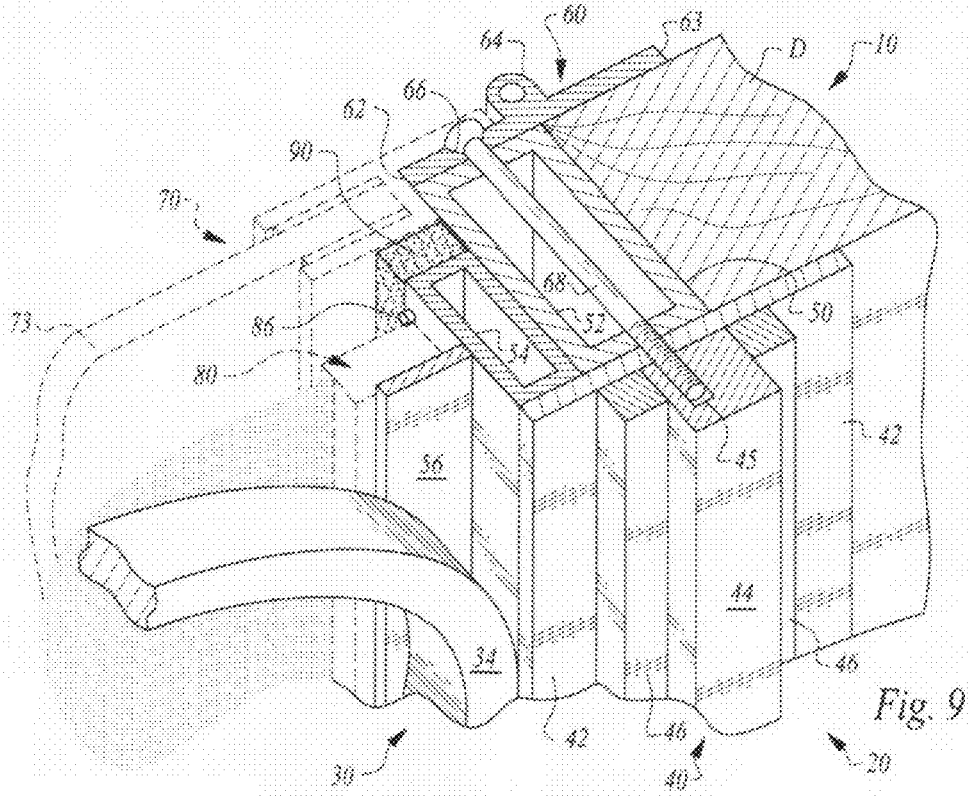
FIG. 9 is a perspective cut away view similar to that which is shown in FIGS. 5-7 but with enlarged detail and further illustrating posts to hold a screen therein.
Figure 10:
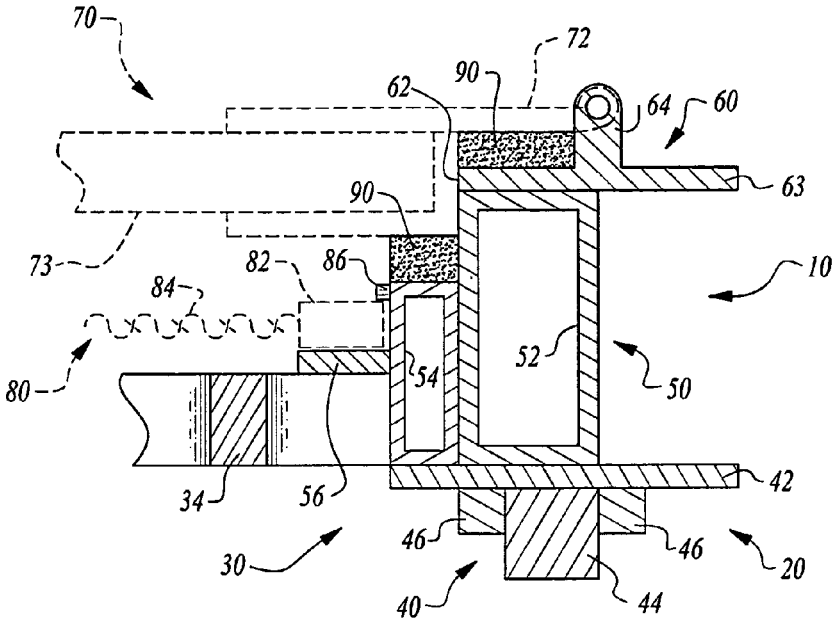
FIG. 10 is a top plan view of portions of the insert shown alone and illustrating how two sets of weather stripping can be provided for sealing of an inner door shown in broken lines, for enhanced weather tight inner door closing capability.

If multiple inner members are supplied as a portion of the body 50, multiple locations are provided for weather stripping 90, while still maintaining a space for the screen 80. This inner member 54 also preferably supports posts 86 which extend in an inward direction and are particularly positioned to allow space for the screen 80 to reside between such posts 86 and the border 32 of the lattice 30 (FIG. 9). A plurality of such posts 86, such as four on each vertical portion of each inner member 54, are preferably provided. These posts 86 preferably have a length which allows the screen 80 to snap past the posts 86 but sufficiently long so that the screen 80 remains in position once placed past the post 86, unless gripped and pushed past the posts 86 for removal.

Most preferably, the flange 56 merely provides the function of a screen rest, and also is located adjacent portions of the lattice 30 to provide added support for the lattice at its junction with the body 50. If more than one element of weather stripping 90 is desired, the barrel hinge portions 64 (FIG. 10) can extend further from the mounting plate 60 and a section of weather stripping 90 can be placed upon the inner door 70 frame 72 or upon the mounting plate 60 and adjacent the hinge portions 64 to provide such a secondary seal.

Together the lattice 30, trim 40 and body 50 define the frame assembly 20. This frame assembly 20 is installed within the hole H in the door D (FIG. 3) by insertion from the exterior of the door D until the body 50 resides within the hole H and the trim 40 is abutting the outside surface O of the door D. Such placement of the frame assembly 20 is preceded by cutting of the hole H with dimensions similar to those of the body 50 of the frame assembly 20.

With continuing reference to FIGS. 2, 3 and 5-10, particular details of the mounting plate 60 are described, according to a most preferred embodiment. The mounting plate 60 defines a second portion of the insert 10 which is affixed to the frame assembly 20 to sandwich the door D therebetween and securely hold the insert 10 within the hole H in the door D. This mounting plate 60 is preferably a planar rectangular perimeter of rigid material such as steel or wrought iron. The mounting plate 60 extends from an inner edge 62 to an outer edge 63, so that the inner edge 62 is inboard of a perimeter of the hole H and the outer edge 63 is outboard of a perimeter of the hole H. Preferably, dimensions of the outer edge 63 are similar to dimensions of an outer edge of the base plate 42 of the trim 40.

The mounting plate 60 is typically formed of material having a thickness similar to that of the base plate 42 of the trim 40. The mounting plate 60 includes a plurality of holes 66 passing therethrough which can receive screws 68 (along arrow C of FIG. 5) or other fasteners (e.g. rivets, nails, clamps, pins, adhesive, etc.) for joining the mounting plate 60 to the frame assembly 20. While these screws 68 are shown passing entirely through the body 50 portion of the frame assembly 20 and threading into portions of the central block 44 of the trim 40, alternatively, the screws 68 or other fasteners could be significantly shorter and only attach into the portions of the body 50 of the frame assembly 20 directly adjacent the mounting plate 50. Preferably, these portions of the body 50 are directly abutting the mounting plate 60. As an alternative, the mounting plate 60 could be spaced at least partially from the body 50 and other portions of the frame assembly 20. As another alternative, the mounting plate 60 could itself extend partially into the hole H so that both the mounting plate 60 and frame assembly 20 extend partially into the hole H.

Figure 16:
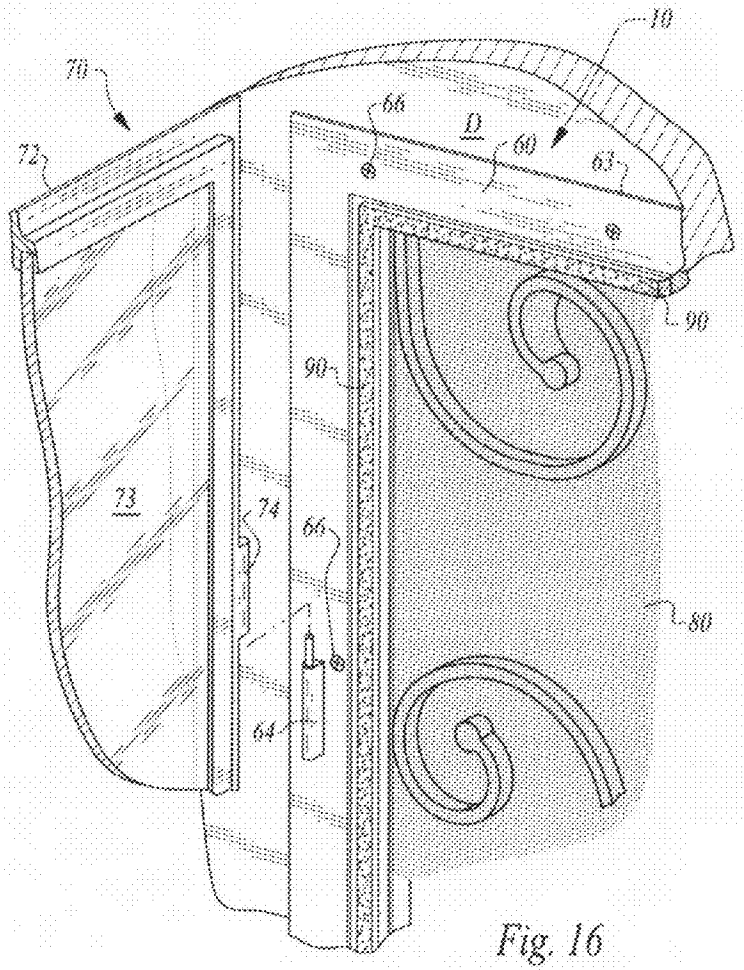
FIG. 16 is a perspective view like FIG. 15 but with the inner door spaced from the mounting plate and aligned for pivotable attachment to the mounting plate.
Figure 15:
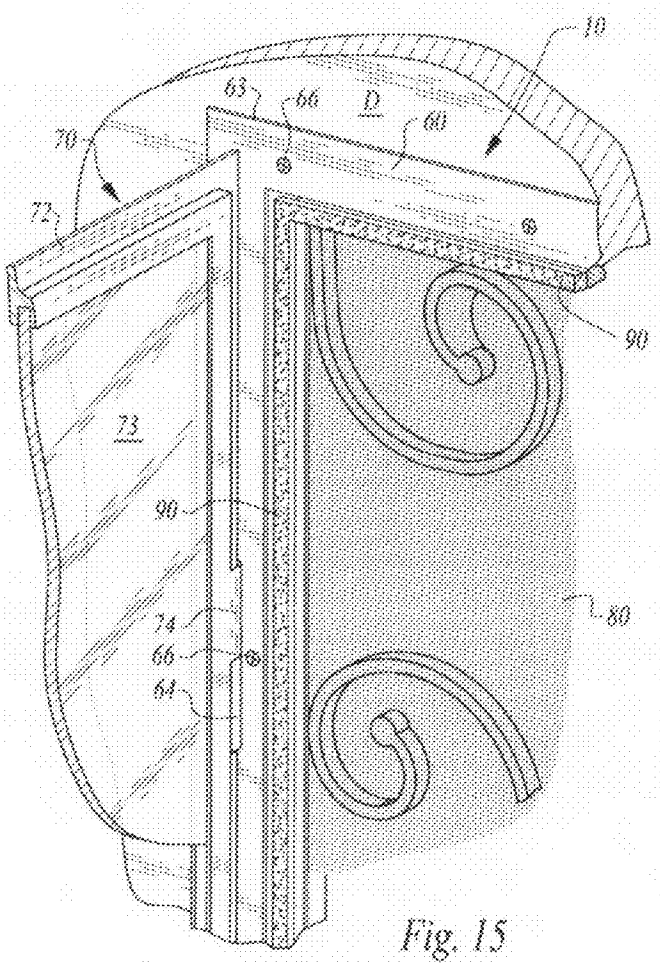
FIG. 15 is a perspective view of a detail of that which is shown in FIG. 14 and revealing further details of the barrel hinge for mounting the inner door to the mounting plate in a preferred form of this invention.

The mounting plate 60 preferably supports a plurality of hinge portions thereon, such as a hinge pintle 64 on one vertical portion of the mounting plate 60. The hinge pintles 64 are welded or otherwise affixed to the mounting plate 60 midway between the inner edge 62 and outer edge 63. These hinge pintles 64 are complemental with hinge barrels 74 associated with the inner door 70 to allow for removable attachment of the inner door 70 to the mounting plate 60 (see FIGS. 15 and 16) and to facilitate pivoting thereof (about arrow A of FIGS. 7 and 14). Most preferably, three or four such hinge pintles 64 and hinge barrels 74 are provided. While shown on a side of the insert 10 that is closest to the knob K of the door D, this arrangement could be reversed to place the hinge portions on a common side of the door D with the leaf hinges L of the door D. Other arrangements are also possible, such as double inner doors with hinge portions on each vertical portion of the mounting plate.

Most preferably, screws 68 or other fasteners are located close to the hinge pintles 64 so that the mounting plate 60 is held fast to the door D and maintains a high degree of rigidity adjacent where these barrel hinges join the inner door 70 to the mounting plate 60. The hinge portions associated with the mounting plate 60 could have a different style than that of a barrel hinge, such as leaf hinges, piano hinges or hinges having leaves which are separately mounted to the inner door 70 and mounting plate 60, rather than being integrated into the mounting plate 60.

With particular reference to FIGS. 2, 3, 5-10, 13 and 14, particular details of the inner door 70 are described, according to a most preferred embodiment. While the inner door 70 could be opaque, most preferably the inner door 70 is at least partially transparent so that light can pass through the inner door 70 and through the insert 10, whether the inner door 70 is open or closed. Typically, such at least partial transparency is provided by mounting a sheet of glass 73 within a frame 72. This frame 72 preferably has a contour which generally matches corresponding portions of the frame assembly 20 and mounting plate 60 so that a tight fit is provided, especially when the inner door 70 is in a closed configuration. This contour can be shaped by extruding the frame 72 with this profile, or by stamping, bending or other forming techniques. While the frame 72 is shown with a pair of integral plates with a gap between for holding the glass 73, preferably an outer one of these plates is a separate element attached to the frame 72, such as with screws or other fasteners to allow for fitting of the glass 73 to the frame 72. Glazing tape can be provided on inner and outer sides of the glass 73 where it abuts the frame 72 as part of this manufacture of the inner door 70. Weather stripping 90 can be provided on the door 70 or on other portions of the insert 10 to seal this inner door 70 to the frame assembly 20 and mounting plate 60 and to provide a weather tight seal when the inner door 70 is closed.

The frame 72 also supports the hinge barrels 74 therein to drop onto the hinge pintles 64 (FIGS. 15 and 16) of the mounting plate 60 to allow for pivotable attachment of the inner door 70 to the mounting plate 60. Preferably, a latch 76 is provided on a side of the inner door 70 opposite the hinge barrels 74. This latch 76 can be rotated (along arrow B of FIG. 13) to lock the inner door 70 in a closed position. This latch 76 preferably includes a finger which rotates between a position overlapping the inner door 70 and holding the inner door 70 closed against the frame assembly 20, and an open position which does not overlie the inner door 70, so that the inner door 70 is free to pivot (along arrow A) to transition between an open and a closed orientation.

The glass 73 within the inner door 70 can be beveled, seeded, smoked, colored or otherwise distorted to allow light to pass therethrough, while minimizing the ability of those outside of the door D to view an interior space on an inside of the door D. The glass 73 can be continuous within the frame 72 or discontinuous with portions of the inner door 70 inboard of the frame 72 being potentially opaque and filled with a planar structure other than glass 73.

While the inner door 70 is shown herein having a size similar to that of the entire hole H, it is conceivable that the inner door 70 would only cover a portion of this hole H. The remaining portion of the hole H spanned by the lattice 30 including portions of the lattice 30 or other portions of the frame assembly 20 being closed off, so that an insert 10 is provided which is only partially openable. For instance, the inner door 70 can be configured so that it only allows for openability of an upper portion of the hole H. Alternatively, multiple inner doors 70 could be provided, such as an upper inner door and a lower inner door which can either be opened together or opened separately as desired.

With particular reference to FIGS. 1, 3-10 and 14, particular details of the screen 80 are described, according to a most preferred embodiment. The screen 80 is optionally but preferably provided as a portion of the insert 10. This screen 80 is preferably of a standard variety including edge supports 82 around a perimeter of a layer of mesh 84 material. This mesh 84 precludes most insects from passing therethrough, and other debris, while still allowing air to pass therethrough for effective ventilation. The screen 80 is sized to fit inboard of the body 50 and adjacent an inner side of the lattice 30. The screen 80 can be snapped past the posts 86 to removably attach the screen 80 adjacent the frame assembly 20.

As an alternative, the screen 80 could be pivotably attached to the frame assembly 20 or mounting plate 60 for pivotable opening of the screen 80. As an alternative to the posts 86, a grooved track could be provided around a perimeter space into which the screen 80 is fitted in a removably attachable fashion, similar to a typical way that screens are mounted within many window spaces. By making the screen 80 removable, the screen 80 can be removed for cleaning or for storage when the user determines that the screen 80 is not needed and when it is desirable to maximize visibility through the insert 10.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A door with an openable insert mounted therein, the door comprising in combination:

a substantially planar door element including an inside surface opposite an outside surface, said inside surface spaced from said outside surface by a door thickness, said door including at least one hinge on a first vertical edge thereof adapted to pivotably mount said door to an adjacent support;

said door including a hole extending from said inside surface to said outside surface, said hole partially defined by a pair of substantially vertical sides located parallel and opposite each other;

said insert located within said hole, said insert including a frame assembly, a mounting plate and an inner door;

said frame assembly sized to fit adjacent said hole and overlap at least portions of said vertical sides of said hole adjacent said outer surface of said door;

said mounting plate sized to fit adjacent said hole and overlap at least portions of said vertical sides of said hole adjacent said inside surface of said door;

said mounting plate removably attachable to said frame assembly through a plurality of elongate fasteners passing through holes in said mounting plate and into holes in said frame assembly;

at least portions of said door sandwiched between said mounting plate and said frame assembly with said fasteners applying a force to clamp said mounting plate and said frame assembly to said door therebetween;

said inner door pivotably mounted to said mounting plate;

wherein said fasteners and said holes in said mounting plate for passage of said elongate fasteners are covered by portions of said inner door when said inner door is pivoted to a closed position, said elongate fasteners extending substantially perpendicular to a major planar face of each of said door and said frame assembly.

2. The door of claim 1 wherein said frame assembly includes at least portions thereof located within said hole in said door and adjacent said vertical sides of said hole.

3. The door of claim 2 wherein said frame assembly includes a body portion and a trim portion, said body portion sized to fit within said hole in said door and adjacent said vertical sides of said hole in said door, said trim portion sized to be located adjacent said outer surface of said door and partially inboard of said vertical sides of said hole and partially outboard of said vertical sides of said hole.

4. The door of claim 3 wherein a lattice structure is included with said body, said lattice structure spanning said hole in said door, said lattice structure formed of substantially rigid elongate elements.

5. The door of claim 4 wherein said lattice includes wrought iron elongate decorative elements inboard of a perimeter border, said perimeter border coupled to portions of said body adjacent said vertical sides of said hole.

6. The door of claim 3 wherein a screen is located inboard of portions of said body adjacent said vertical sides of said hole, said screen removably attachable adjacent said body.

7. The door of claim 3 wherein said mounting plate abuts at least a portion of said body.

8. The door of claim 3 wherein said trim portion includes an interior bore aligned with said holes in said mounting plate, said interior bore configured to be secured to said fastener.

9. The door of claim 1 wherein a lattice structure is included with said body, said lattice structure spanning said hole in said door, said lattice structure formed of substantially rigid elongate elements.

10. The door of claim 9 wherein a screen is provided on an inner side of said lattice and inboard of portions of said frame assembly inboard of said vertical sides of said hole.

11. The door of claim 10 wherein said inner door includes a frame surrounding a glass panel, said inner door located on a side of said screen opposite said lattice, said frame of said inner door including a first portion of a barrel hinge with said mounting plate including a second portion of a barrel hinge complemental with said first portion of said barrel hinge to pivotably attach said inner door to said mounting plate.

12. The door of claim 1 wherein said inner door includes at least one hinge pivotably joining said inner door to said mounting plate.

13. The door of claim 12 wherein said inner door includes a plurality of barrels adapted to rest upon and rotate about a plurality of complementally formed hinge pintles upon said mounting plate.

14. The door of claim 1 wherein said fasteners include screws.

* * * * *